US006620008B2

(12) United States Patent
Green

(10) Patent No.: US 6,620,008 B2
(45) Date of Patent: Sep. 16, 2003

(54) SWIM FIN

(76) Inventor: Arthur Clive Green, Sunbird Cottage, Avondrust Circle, Noordhoek, Cape Town, 7985 (ZA)

( * ) Notice: Subject to any disclaimer, the term of this patent is extended or adjusted under 35 U.S.C. 154(b) by 0 days.

(21) Appl. No.: 10/065,628

(22) Filed: Nov. 4, 2002

(65) Prior Publication Data

US 2003/0036321 A1 Feb. 20, 2003

Related U.S. Application Data

(63) Continuation of application No. PCT/IB01/00760, filed on May 4, 2001.

(51) Int. Cl.[7] ..... A63B 31/08
(52) U.S. Cl. ..... 441/64
(58) Field of Search ..... 441/64

(56) References Cited

U.S. PATENT DOCUMENTS

| | | | | | |
|---|---|---|---|---|---|
| 1,607,857 | A | * | 11/1926 | Zukal | 441/64 |
| 2,950,487 | A | * | 8/1960 | Woods | 441/64 |
| 3,867,734 | A | | 2/1975 | Courageux | |
| 4,838,824 | A | | 6/1989 | McCredie | |
| 5,108,327 | A | * | 4/1992 | Klein | 441/62 |
| 5,259,798 | A | | 11/1993 | Runckel | |
| 5,795,204 | A | | 8/1998 | Bruner | |
| 5,868,593 | A | * | 2/1999 | Feng | 441/64 |
| 2002/0037677 | A1 | * | 3/2002 | Gibbons et al. | 441/64 |

FOREIGN PATENT DOCUMENTS

| | | |
|---|---|---|
| GB | 301 702 | 12/1928 |

OTHER PUBLICATIONS

International Search Report for PCT/IB01/00760.
International Preliminary Examination Report for PCT/IB01/00760.

* cited by examiner

*Primary Examiner*—Stephen Avila
(74) *Attorney, Agent, or Firm*—Carter J. White; Howrey Simon Arnold & White LLP

(57) ABSTRACT

A swim fin (10) having a foot-pocket formation (12) and a fin blade (14). The foot-pocket formation (12) defines a foot-receiving cavity in which a foot can be received. The fin blade (14) comprises a frontal blade portion (30) and a pair of side blade portions (32.1 and 32.2). The frontal blade portion extends longitudinally from a toe end of the foot-pocket formation and has a predetermined length and is spaced a predetermined height above an underside of the foot-pocket formation, which permits a wearer to walk unimpeded while wearing the swim fin. Each side blade portion includes a fixed blade section (36) and a flap formation (38) that is hingedly displaceable relative to the fixed blade section so as to change an edge profile of the fin blade, in use, for increasing the surface area of the fin blade during a propulsion stroke and decreasing the surface area thereof during a return stroke.

8 Claims, 7 Drawing Sheets

SWIM FIN

CROSS REFERENCE TO RELATED APPLICATIONS

This application is a continuation of an International Patent Application designating the United States, Application No. PCT/IB01/00760; Filed: May 4, 2001 which in turn claims priority under the Paris Convention to South African Patent Application No. 2000/2210; filed: May 5, 2000.

THE FIELD OF INVENTION

This invention relates to a swim fin.

Swim fins substantially increase the surface area of a swimmer's foot thereby to increase the propulsive force exerted by the foot on the water when swimming. Such fins generally include a fin blade that extends longitudinally beyond a user's foot for a substantial length. Although useful in water, swim fins are cumbersome and inefficient when worn while walking as the portion of the fin blade that extends beyond the user's foot severely impedes walking.

Another problem associated with many swim fins is that the fin blade extends longitudinally beyond a foot region of the swim fin, with the result that the fin blade pivots about the foot region when swimming. This causes a reaction force substantially equivalent to the propulsive force exerted by the fin blade on the water, to be exerted on a relatively small area of an upper region of the person's foot. As a consequence, this exerts a relatively high pressure on the upper region of the person's foot which can be quite painful.

SUMMARY OF INVENTION

According to a first aspect of the invention there is provided a swim fin comprising a foot-pocket formation defining a foot-receiving cavity, the foot-receiving cavity defining a longitudinal axis and having a top side, a bottom side, a toe end, a heel end and two sides that extend between the heel and toe ends; and a fin blade that is spaced a predetermined distance above the bottom side of the foot-pocket formation and that extends in a direction away from the heel end of the foot-pocket formation, no further than a predetermined distance beyond the length of the foot-pocket formation, thereby to permit walking while wearing the swim fin, in use.

The ratio of the length of the fin blade measured between the toe end of the foot-pocket formation and a front end of the fin blade, with respect to a height of the fin blade measured between the bottom side of the foot-pocket formation and an underside of the fin blade, may be between 1:0.25 and 1:0.4.

Said length of the fin blade may be between 80 mm and 100 mm.

Said height of the fin blade may be between 25 mm and 40 mm.

Optimally, the ratio of said length of the fin blade with respect to said height of the fin blade, may be approximately 1:0.35.

The fin blade may have a substantially planar shape.

The fin blade is integrally formed with the foot-pocket formation.

The fin blade may include a frontal blade portion that extends longitudinally from the toe end of the foot-pocket formation and a pair of side blade portions that each extend transversely with respect to the longitudinal axis of the foot-pocket formation from a different side of the foot-pocket formation between the toe end of the foot-pocket formation and at least a position disposed near the talus of the foot of a person wearing the swim fin, in use.

Each side blade portion may comprise a fixed blade section and a moveable blade section in the form of a flap formation that is hingedly displaceable relative to the fixed blade section about an axis that extends substantially parallel to the longitudinal axis of the foot-pocket formation, between an extended position wherein an upper surface of the flap formation is disposed substantially co-planar with an upper surface of the fixed blade section, thereby increasing the effective surface area of the fin blade during a propulsion stroke of the swim fin, in use, and a collapsed condition wherein the flap formation extends rearwardly with respect to the direction of movement of the fin blade through a body of water.

A swim fin as claimed in claim 9, wherein the fixed blade section of each side blade portion, may includes a stop formation which prevents displacement of the flap formation relative to the fixed blade section beyond said extended position of the flap formation.

According to a second aspect of the invention there is provided a swim fin comprising a foot-pocket formation defining a foot-receiving cavity, the foot-receiving cavity defining a longitudinal axis and having a top side, a bottom side, a toe end, a heel end and two sides that extend between the heel and toe ends; and a fin blade that comprises a frontal blade portion that extends longitudinally from the foot-pocket formation in a direction away from the heel end thereof and a pair of side blade portions that each extend transversely with respect to the longitudinal axis of the foot-pocket formation from a different side of the foot-pocket formation between the toe end of the foot-pocket formation and at least a position disposed near the talus of the foot of a person wearing the swim fin, in use.

The frontal blade portion of the fin blade may be spaced a predetermined distance above the bottom side of the foot-pocket formation and extends in a direction away from the heel end of the foot-pocket formation, no further than a predetermined distance beyond the toe end of the foot-pocket formation, thereby to permit walking while wearing the swim fin, in use.

The ratio of the length of the frontal blade portion of the fin blade, may be measured between the toe end of the foot-pocket formation and a front end of the frontal blade portion, with respect to a height of the frontal blade portion of the fin blade, measured between the bottom side of the foot-pocket formation and an underside of the frontal blade portion, is between 1:0.25 and 1:0.4.

Said length of the frontal blade portion of the fin blade, may be between 80 mm and 100 mm.

Said height of the frontal blade portion of the fin blade, may be between 25 mm and 40 mm.

The ratio of said length of the frontal blade portion of the fin blade, with respect to said height of the frontal blade portion, may be approximately 1:0.35.

The fin blade may have a substantially planar shape.

The fin blade may be integrally formed with the foot-pocket formation.

Each side blade portion may comprise a fixed blade section and a moveable blade section in the form of a flap formation that is hingedly displace able relative to the fixed blade section about an axis that extends substantially parallel to the longitudinal axis of the foot-pocket formation, between an extended position wherein an upper surface of the flap formation is disposed substantially co-planar with an upper surface of the fixed blade section, thereby increasing the effective surface area during a propulsion stroke of the swim fin, in use, and a collapsed condition wherein the flap formation extends rearwardly with respect to the direction of movement of the fin blade through a body of water.

The fixed blade section of each side blade portion, may include a stop formation which prevents displacement of the flap formation relative to the fixed blade section beyond said extended position of the flap formation.

According to a third aspect of the invention there is provided a swim fin comprising a foot-pocket formation defining a foot receiving cavity, the foot receiving cavity defining a longitudinal axis and having a top side, a bottom side, a toe end, a heel end and two sides that extend between the heel and toe ends; and a fin blade that comprises a frontal blade portion that extends longitudinally from the foot-pocket formation in a direction away from the heel end thereof and a pair of side blade portions that each extend transversely with respect to the longitudinal axis of the foot-pocket formation from a different side of the foot-pocket formation between the toe end of the foot-pocket formation and at least a position disposed near the talus of the foot of a person wearing the swim fin, in use, each side fine blade portion comprising a fixed blade section and a moveable blade section in the form of a flap formation that is hingedly displaceable relative to the fixed blade section about an axis that extends substantially parallel to the longitudinal axis of the foot pocket formation, between an extended position wherein an upper surface of the flap formation is disposed substantially co-planar with an upper surface of the fixed blade section, thereby increasing the effective surface area of the fin blade during a propulsion stroke of the swim fin, in use, and collapsed condition wherein the flap formation extends rearwardly with respect to the direction of movement of the fin blade through a body of water.

The fixed blade section of each side blade portion of the fin blade, may include a stop formation which prevents displacement of the flap formation relative to the fixed blade section beyond said extended position of the flap formation.

The ratio of the length of the frontal blade portion of the fin blade, measured between the toe end of the foot-pocket formation and a front end of the frontal blade portion, with respect to a height of the frontal blade portion measured between the bottom side of the foot-pocket formation and an underside of the frontal blade portion, may be between 1:0.25 and 1:0.4.

Said length of the frontal blade portion may be between 80 mm and 100 mm.

Said height of the frontal blade portion of the fin blade, may be between 25 mm and 40 mm.

DESCRIPTION OF PREFERRED EMBODIMENT

Further features of the invention are described hereinafter by way of a non-limiting example of the invention, with reference to and as illustrated in the accompanying diagrammatic drawings.

Figure 1:
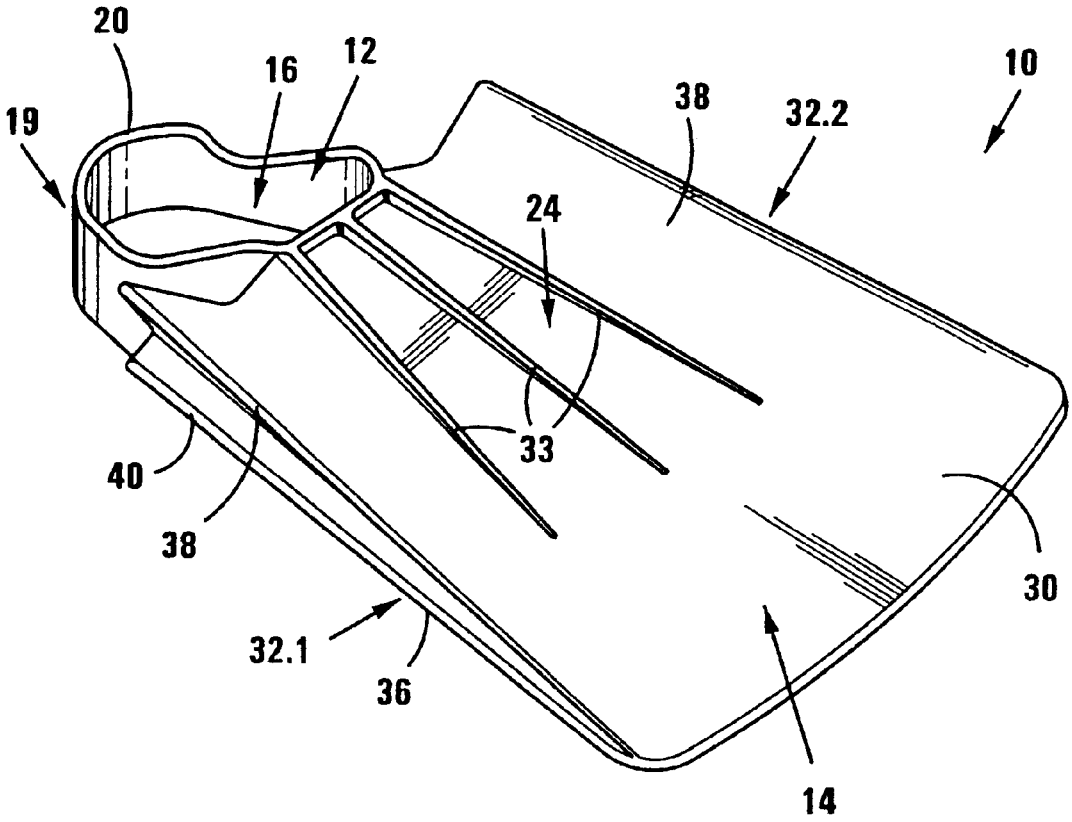
FIG. 1 shows a schematic three-dimensional view of a swim fin in accordance with the invention.

With reference to the drawings, a swim fin in accordance with the invention is designated generally by the reference numeral 10. The swim fin 10 is of moulded synthetic rubber and comprises, broadly, a foot-pocket formation 12 and a fin blade 14 that is formed integrally with the foot pocket formation.

The foot-pocket formation defines a foot-receiving cavity 16 in which the foot 18 of a wearer can be received. The foot pocket formation 12 has an open heel and includes a heel end 19 having a strap 20 that can be located around a wearer's ankle, a toe end 22, a top side 24, a bottom side 26 and two lateral sides 28.1 and 28.2 that extend between the heel and toe ends. The foot pocket formation 12 defines a longitudinal axis A that extends along its length. The bottom side 26 defines a number of tread formations 29.

The top side 24 of the foot-pocket formation defines three longitudinal ridges 33 that assist in channelling water over the swim fin, in use. This assists in maintaining directional stability of the swim fin when it is displaced through a body of water, in use.

The fin blade 14 comprises a frontal blade portion 30 and a pair of side blade portions 32.1 and 32.2 that are formed integrally with the frontal blade portion. The frontal blade portion extends longitudinally from the toe end 22 of the foot pocket formation 12 in a direction away from the heel end of the foot pocket formation. Each of the side blade portions 32.1 and 32.2 extend transversely with respect to the longitudinal axis A of the foot pocket formation, from a different side of the foot pocket formation. Each side blade portion extends between the toe end 22 of the foot pocket formation and a position that is disposed near the talus ("ankle bone") 34 of a person wearing the swim fin, in use. More particularly, each side blade portion extends rearwardly to a position that is disposed directly below the wearer's ankle bone 34. Each side blade portion comprises a fixed blade section 36 and a moveable blade section in the form of a flap formation 38 that is hingedly displaceable relative to the fixed blade section about an axis that extends substantially parallel to the longitudinal axis A of the foot pocket-formation 12. More particularly, outer side edges of the side blade portions 32.1 and 32.2 taper slightly from the toe end of the foot pocket towards the heel end thereof.

Figure 7:
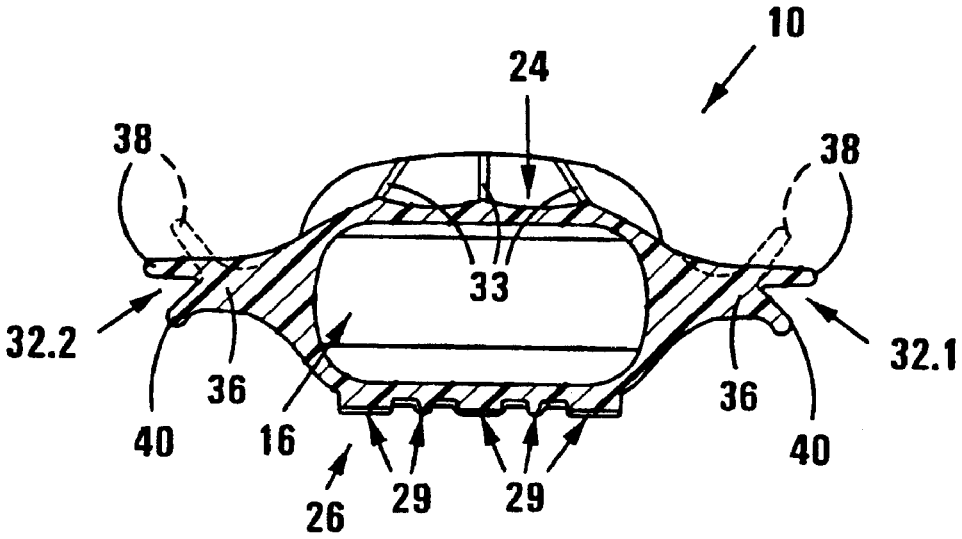
FIG. 7 shows a schematic sectional end view of the swim fin of FIG. 1, sectioned along section line VII—VII of FIG. 2.

The flap formation 38 of each side blade portion, is hingedly displaceable relative to the fixed blade section 36 thereof, between an extended position (as shown in solid lines in FIG. 7 of the drawings) wherein an upper surface of the flap-formation is disposed substantially co-planar with an upper surface of the fixed blade section and a collapsed condition (as shown by the broken lines in FIG. 7 of the drawings). In the extended condition of the flap formation, it will be appreciated that the effective surface area of the fin blade is increased during a propulsion stroke of the swim fin, in use. In its collapsed condition, the flap formation 38 extends rearwardly with respect to the direction of movement of the fin blade through a body of water during a return stroke (i.e. in a direction opposite to a propulsion stroke) thereby effectively reducing the surface area of the fin blade. As the swim fin in an integrally moulded unit, the flap formation 38 is displaced, in use, relative to the fixed blade section of each side blade section by being bent when acted upon by the force of water during a propulsion or return stoke, in use. As such, the properties of the rubber material of the fin blade and the thickness of the flap formations, particularly in the region of a join formed between the flap formations and the fixed blade sections, determine the deformability of the flap formation.

The fixed blade section 36 of each side blade portion includes an elongate peripheral stop formation 40 which prevents displacement of the flap relative to the fixed blade section beyond the extended position of the flap formation during a propulsion stroke.

In collapsed conditions thereof, the flap formations 38 define channels 39 which serve to 'channel' water flowing over the swim fin during a return stroke. The channels also serve to enhance the directional stability of the swim fin in a body of water during a return stroke.

The tread formations 29 taper from the toe end of the foot pocket formation 12 toward the heel end thereof. In use, this has the effect of causing a wearer's foot to extend slightly upwardly toward the fin blade. This serves to raise the front end of wearer's foot thereby bringing it closer to the fin blade. The Applicant has found that inclining a wearer's foot as described above allows for a more efficient propulsion stroke to be executed, in use.

Figure 2:
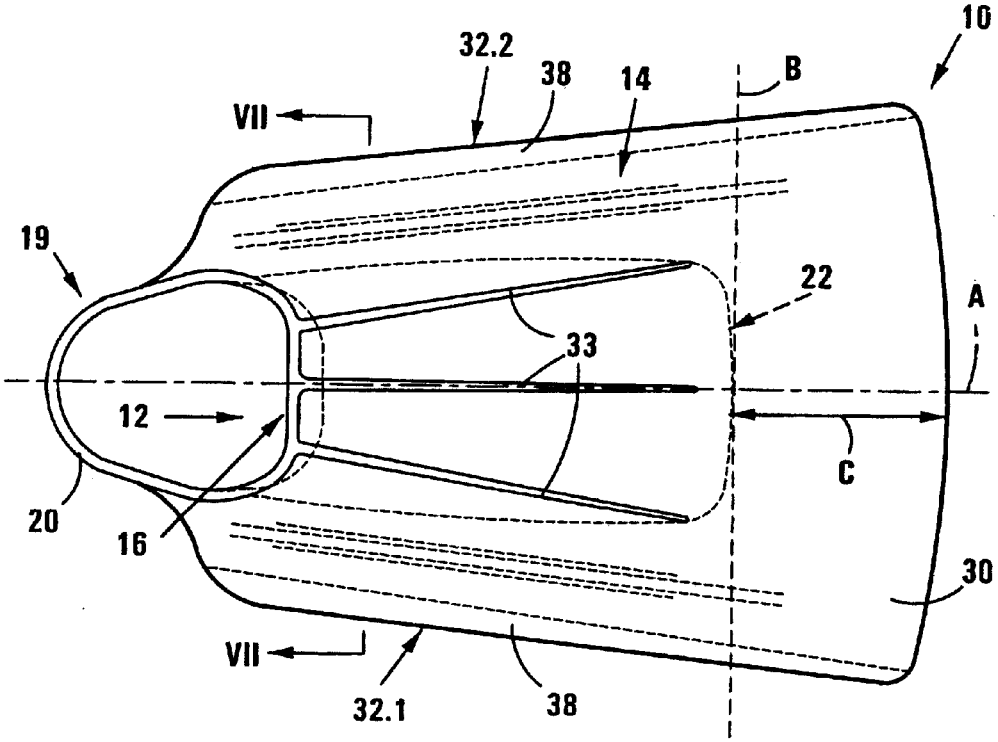
FIG. 2 shows a schematic top plan view of the swim fin of FIG. 1.
Figure 3:
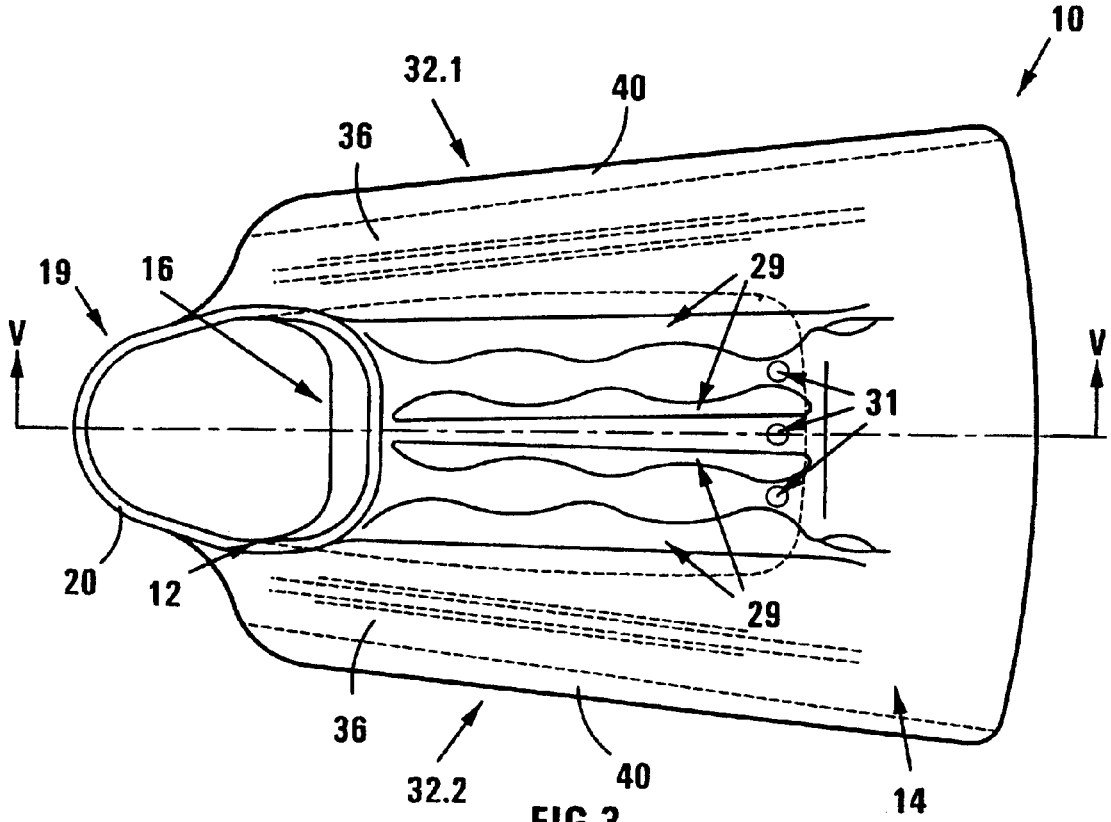
FIG. 3 shows a schematic bottom plan view of the swim fin of FIG. 1.
Figure 4:
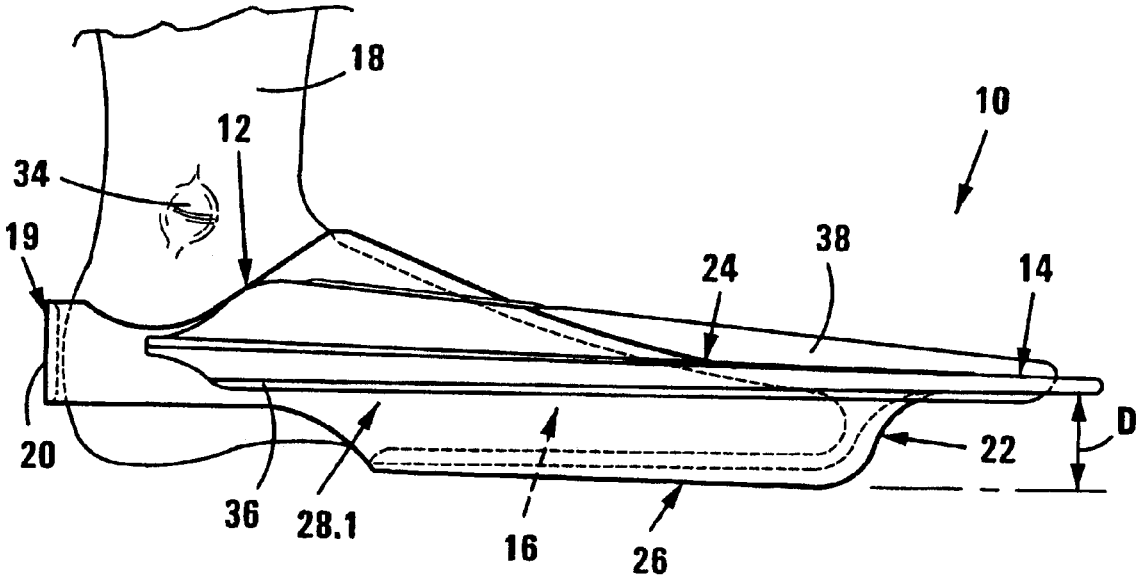
FIG. 4 shows a schematic side view of the swim fin of FIG. 1.
Figure 5:
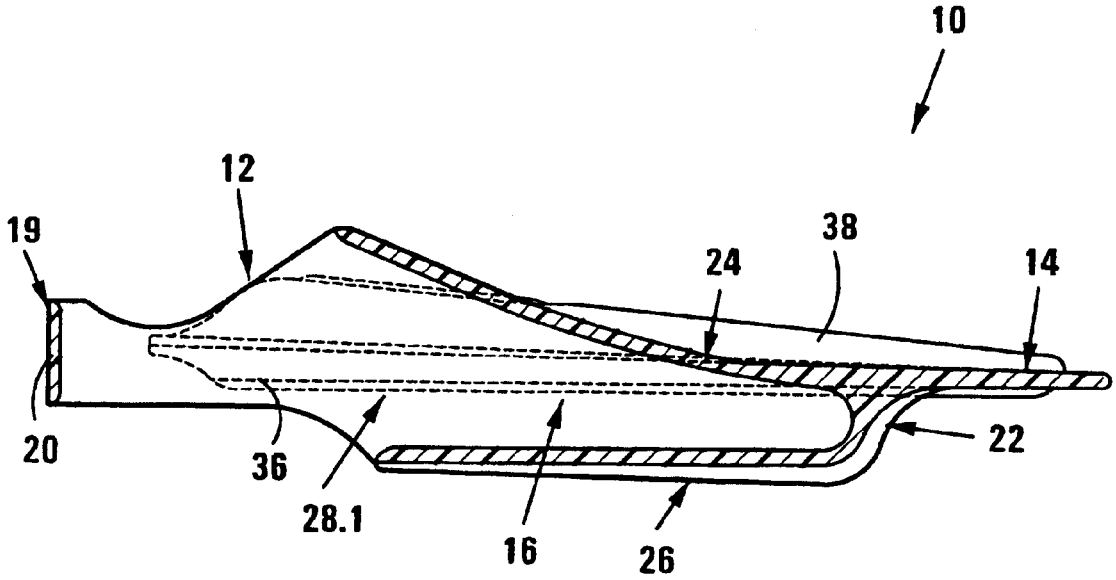
FIG. 5 shows a schematic sectional side view of the swim fin of FIG. 1, sectioned along section line V—V of FIG. 3.
Figure 6:
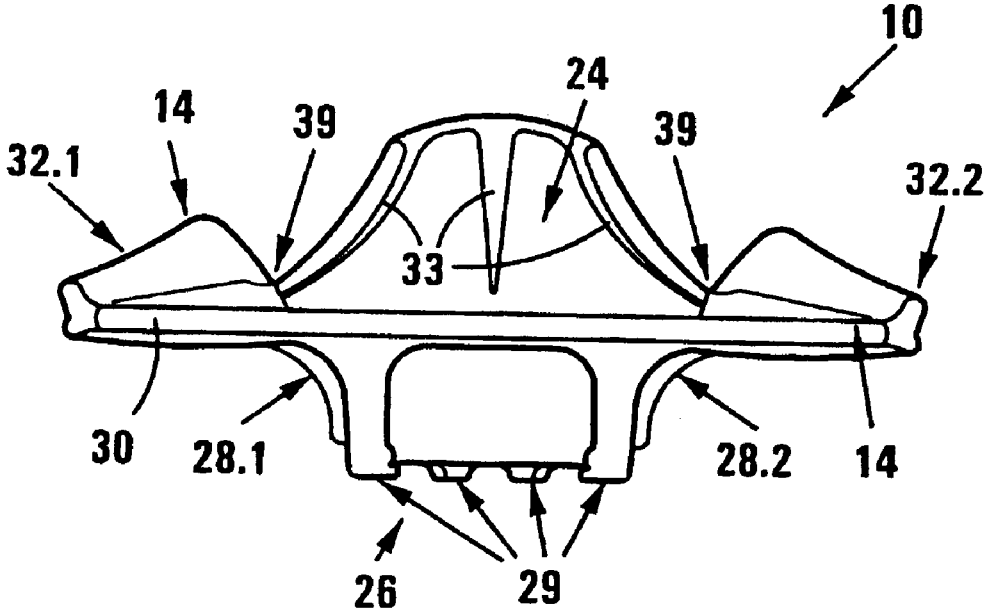
FIG. 6 shows a schematic front end view of the swim fin of FIG. 1.

The frontal blade portion 30 extends a length C beyond the toe end of the foot-pocket formation 12 (designated by broken line B in FIG. 2) and the frontal blade portion of the fin blade, and is spaced a height D above the bottom side 26 of the foot pocket formation 12. Preferably, the ratio of the length C with respect to the height D is between 1:0.25 and 1:0.4. Also, preferably, the length of the fin blade is typically 80 mm to 100 mm and the height of the fin blade is between 25 mm and 40 mm. The Applicant has found that an optimum ratio of the length C with respect to the height D is approximately 1:0.35.

The length C of the frontal blade portion of the fin blade, and the height D of the frontal blade portion above the bottom side 26 of the foot pocket formation 12, combine to permit unimpeded walking by a person wearing the swim fin. It will be appreciated that with a conventional swim fin having a relatively long fin blade, walking will be extremely difficult and possibly even dangerous. By elevating the fin blade above the underside of the foot pocket formation and by shortening the effective length of the fin blade, the Applicant has provided a fin blade having a configuration which permits a person to walk while wearing the swim fin. In order to compensate for the apparent reduction in surface area of the fin blade, the laterally-extending side blade portions significantly increase the lateral surface area of the fin blade. The Applicant has found that the side blade portions of the fin blade, are efficient in increasing the propulsive force exerted by the foot on the water when swimming using the swim fins. This effect is increased by the moveable flap formations as explained hereinabove. During a return stroke, the effective surface area is decreased thereby providing less resistance to movement of the swim fin through a body of water. In addition, it has been found that the laterally-extending side blade portions 32.1 and 32.2 have the effect of spreading the reaction force acting on the foot of a wearer of the swim fin, over a larger area. This has the effect of reducing the pressure acting on the upper region of a person's foot when wearing the swim fin.

What is claimed is:

1. A swim fin comprising a foot-pocket formation defining a foot-receiving cavity, the foot-receiving cavity defining a longitudinal axis and having a top side, a bottom side, a toe end, a heel end and two sides that extend between the heel and toe ends; and a fin blade that is spaced predetermined distance above the bottom side of the foot-pocket formation and that extends in a direction away from the heel end of the foot-pocket formation, no further than a predetermined distance beyond the length of the foot-pocket formation, thereby to permit walking while wearing the swim fin, in use, the fin blade including a frontal blade portion that extends longitudinally from the toe end of the foot-pocket formation and a pair of side blade portions that each extend outwardly transversely with respect to the longitudinal axis of the foot-pock t formation from a different side of the foot-pocket formation between the toe end of the foot-pocket formation and at least a position disposed opposite an ankle of a person wearing the swim fin, in use, each side blade portion comprising a fixed blade section and a moveable blade section in the form of a flap formation that is hingedly displaceable relative to the fixed blade section about an axis that extends substantially parallel to the longitudinal axis of the foot-pocket formation, between an extended position wherein an upper surface of the flap formation is disposed substantially co-planar with an upper surface of the fixed blade section, thereby increasing the effective surface area of the fin blade during a propulsion stroke of the swim fin, in use, and a collapsed condition wherein the flap formation extends rearwardly with respect to the direction of movement of the fin blade through a body of water.

2. A swim fin as claimed in claim 1, wherein a ratio of the length of the fin blade measured between the toe end of the foot-pocket formation and a front end of the fin blade, with respect to a height of the fin blade measured between the bottom side of the foot-pocket formation and an underside of the fin blade, is between 1:0.25 and 1:0.4.

3. A swim fin as claimed in claim 2, wherein said length of the fin blade is between 80 mm and 100 mm.

4. A swim fin as claimed in claim 2, wherein said height of the fin blade is between 25 mm and 40 mm.

5. A swim fin as claimed in claim 2, wherein the ratio of said length of the fin blade with respect to said height of the fin blade, is approximately 1:0.35.

6. A swim fin as claimed in claim 1, wherein the fin blade has a substantially planar shape.

7. A swim fin as claimed in claim 1, wherein the fin blade is integrally formed with the foot-pocket formation.

8. A swim fin as claimed in claim 1, wherein the fixed blade section of each side blade portion, includes a stop formation which prevents displacement of the flap formation relative to the filed blade section beyond said extended position of the flap formation.

* * * * *

UNITED STATES PATENT AND TRADEMARK OFFICE

CERTIFICATE OF CORRECTION

PATENT NO. : 6,620,008 B2
DATED : September 16, 2003
INVENTOR(S) : Arthur Clive Green It is certified that error appears in the above-identified patent and that said Letters Patent is hereby corrected as shown below:

Column 2,
Line 18, delete "A swim fin as claimed in claim 9, wherein the" and insert -- The --
Line 19, delete "includes" and insert -- include --

Column 6,
Line 13, after "spaced" insert -- a --
Line 23, delete "foot-pock t" and insert -- foot pocket --
Line 61, delete "filed" and insert -- fixed --

Signed and Sealed this

Sixth Day of April, 2004

JON W. DUDAS
*Acting Director of the United States Patent and Trademark Office*